US007714175B2

(12) United States Patent
Abe et al.

(10) Patent No.: US 7,714,175 B2
(45) Date of Patent: May 11, 2010

(54) PRODUCTION METHOD OF AROMATIC HYDROXIDE

(75) Inventors: Ryu Abe, Sapporo (JP); Bunsho Ohtani, Sapporo (JP); Osamu Tomita, Sapporo (JP)

(73) Assignees: Sumitomo Chemical Company, Limited, Tokyo (JO); National University Corporation Hokkaido University, Hokkaido (JP)

( * ) Notice: Subject to any disclaimer, the term of this patent is extended or adjusted under 35 U.S.C. 154(b) by 0 days.

(21) Appl. No.: 12/385,013

(22) Filed: Mar. 27, 2009

(65) Prior Publication Data

US 2009/0318736 A1 Dec. 24, 2009

(30) Foreign Application Priority Data

Jun. 20, 2008 (JP) ..... 2008-162152

(51) Int. Cl.
*C07C 39/10* (2006.01)
*C07C 37/60* (2006.01)

(52) U.S. Cl. ..... 568/763; 568/771

(58) Field of Classification Search ..... 568/763, 568/771

See application file for complete search history.

(56) References Cited

FOREIGN PATENT DOCUMENTS

WO WO 2006/043075 A1 4/2006

OTHER PUBLICATIONS

Fujihara et al., "Heterogeneous photocatalytic reactions on semiconductor materials," J. Electroanal. Chem., 1981, 126:277-281.

Park et al., "Photocatalytic conversion of benzene to phenol using modified $TiO_2$ and polyoxometalates," Catalysis Today, 2005, 101:291-297.

Shimamura et al., "Titanium dioxide photocatalyzed oxidation of aromatic hydrocarbons: The role of water and oxygen to induce aromatic hydroxylation," Chemistry Letters, 1983, 1691-1694.

Walling, Cheves, "Fentons' Reagent Revisited," Acc. Chem. Res., 1975, 8:125-131.

*Primary Examiner*—Sikarl A Witherspoon
(74) *Attorney, Agent, or Firm*—Foley & Lardner LLP

(57) ABSTRACT

According to the present invention, two hydroxyl groups can be introduced into the 1-position and the 4-position of the benzene ring of an aromatic compound highly efficiently and highly selectively by a one step process to give the corresponding aromatic hydroxide.

The present invention provides a production method of an aromatic hydroxide represented by the formula (2)

(2)

wherein $R^1$, $R^2$, $R^3$, and, $R^4$ are each independently a hydrogen atom or an alkyl group having a carbon atom number of 1-20, and $R^1$, $R^2$ and/or $R^3$ and $R^4$ are optionally bonded to each other to form a ring, which comprises irradiating light to a photoelectrode comprised of metal oxide while applying a given potential in the presence of an aromatic compound represented by the formula (1)

(1)

wherein $R^1$, $R^2$, $R^3$, and $R^4$ are as defined above.

16 Claims, 1 Drawing Sheet

PRODUCTION METHOD OF AROMATIC HYDROXIDE

TECHNICAL FIELD OF THE INVENTION

The present invention relates to a production method of aromatic hydroxide.

BACKGROUND OF THE INVENTION

It is well known that aromatic hydroxides represented by phenol, catechol, resorcinol and hydroquinone are important chemical products used for various applications such as photographic reagents, antioxidants and the like. Ideally, synthesis of aromatic hydroxides is performed in one step by oxidation of the corresponding aromatic hydrocarbon; however, selective oxidation of aromatic compound is difficult. To synthesize hydroxide from the corresponding hydrocarbon by one step oxidation, use of a highly dangerous peroxide such as hydrogen peroxide and peracetic acid is required (patent document 1, non-patent document 1). Thus, the development of a reaction to safely convert aromatic hydrocarbon to the corresponding aromatic hydroxide has been desired. Particularly, since control of reactivity is extremely difficult during selective introduction of plural hydroxyl groups and the synthesis requires multistep reactions, the development of a superior production method has been desired. Heretofore, direct hydroxylation of aromatics using photocatalyst powder particles such as titanium oxide and the like has also been considered, and it is known that hydroxide is in fact produced. However, since hydroxide produced is sequentially oxidized to allow cleavage of aromatic ring and peroxidation up to carbon dioxide, both the reaction yield and the selectivity are extremely low. In general, when a photocatalyst powder such as titanium oxide and the like is utilized for the reaction, an oxygen molecule is used as an electron acceptor that efficiently reacts with the electron produced by photoexcitation. When an oxygen molecule is present, however, peroxidation reaction by radical chain reaction is promoted, which markedly decreases the yield and the selectivity of the object product. Moreover, when ultraviolet rays are irradiated to excite titanium oxide, photochemical reaction of aromatic compounds progresses to further decrease the selectivity of the object hydroxide (non-patent documents 2, 3, 4).

patent document 1: WO 2006-043075
non-patent document 1: Acc. Chem. Res., vol. 8, page 125 (1975)
non-patent document 2: J. Electroanal. Chem. vol. 126, page 277 (1981)
non-patent document 3: Catalysis Today, vol. 101, page 291 (2005)
non-patent document 4: Chemistry Letters, page 1691 (1983)

SUMMARY OF THE INVENTION

Problems to be Solved by the Invention

In view of the above-mentioned situation, the present invention aims to introduce a plurality of hydroxyl groups at once and with high efficiency and high selectively by a safe and efficient oxidation reaction of aromatic hydrocarbon.

Means of Solving the Problems

The present inventors have conducted intensive studies to solve the above-mentioned problems. As a result, they have found that, in a hydroxylation reaction of an aromatic compound by a photoelectrochemical reaction, when a photoelectrode comprised of tungsten oxide etc. is immersed in a reaction solution and light is irradiated to the photoelectrode while applying a given potential, excited electrons are led to the counter electrode and efficiently consumed by hydrogen production by reduction of water, the hole left in the photoelectrode reacts with the aromatic compound without cleavage of the aromatic compound and, consequently, two hydroxyl groups can be highly efficiently and highly selectively introduced into the 1-position and the 4-position of the benzene ring of the aromatic compound, which resulted in the completion of the present invention.

Accordingly, the present invention provides the following.

[1] A production method of an aromatic hydroxide represented by the formula (2)

(2)

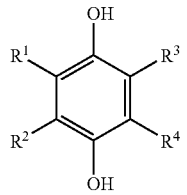

wherein $R^1$, $R^2$, $R^3$, and, $R^4$ are each independently a hydrogen atom or an alkyl group having a carbon atom number of 1-20, and $R^1$, $R^2$ and/or $R^3$ and $R^4$ are optionally bonded to each other to form a ring, which comprises irradiating light to a photoelectrode comprised of metal oxide while applying a given potential in the presence of an aromatic compound represented by the formula (1)

(1)

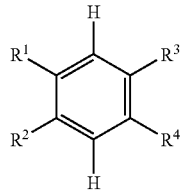

wherein $R^1$, $R^2$, $R^3$, and $R^4$ are as defined above.

[2] The production method of [1], wherein $R^1$, $R^2$, $R^3$, and $R^4$ are each a hydrogen atom.

[3] The production method of [1] or [2], wherein the metal oxide comprises tungsten oxide.

[4] The production method of [1] or [2], wherein the metal oxide is tungsten oxide.

[5] The production method of [4], wherein the tungsten oxide is prepared by ion exchange of tungstate.

[6] The production method of [5], wherein the tungstate is sodium tungstate.

[7] The production method of [1] or [2], wherein the photoelectrode comprised of metal oxide is obtained by coating a transparent electrode with metal oxide.

[8] The production method of [7], wherein the transparent electrode is a fluorine-doped tin oxide (FTO) electrode.

[9] The production method of any one of [1] to [8], wherein the light comprises a visible light region.

[10] The production method of any one of [1] to [8], wherein the light is a visible light.

[11] The production method of any one of [1] to [10], which is performed using a two-compartment cell type apparatus wherein the photoelectrode comprised of metal oxide and the counter electrode are separated by an ion exchange membrane.

[12] The production method of any one of [1] to [11], which is performed in the presence of a solvent.

[13] The production method of [12], wherein the solvent comprises water.

[14] The production method of [12], wherein the solvent is a mixed solvent of acetonitrile and water.

[15] The production method of any one of [12] to [14], wherein oxygen is removed from the solvent before irradiation of light.

[16] The production method of any one of [1] to [15], wherein the given potential is −0.5 V-2.0 V.

EFFECT OF THE INVENTION

According to the present invention, a hydroxyl group can be selectively introduced in one step into the 1- and 4-positions of the benzene ring of an aromatic compound. For example, hydroquinone can be highly selectively synthesized from benzene in one step.

EXPLANATION OF SYMBOLS

Figure 1:
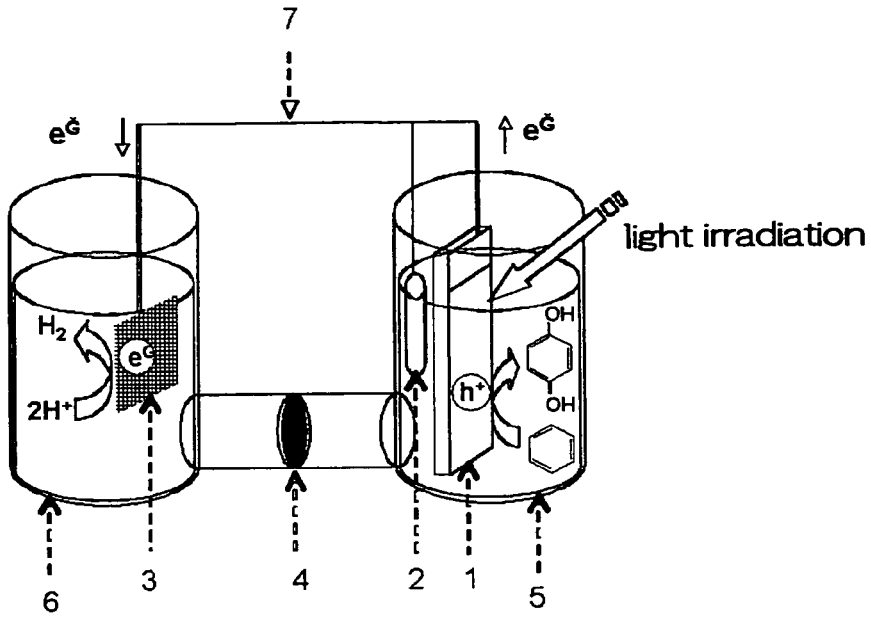
FIG. 1 shows the constitution of a two-compartment cell type apparatus used to perform the production method of the present invention.

1 working electrode (tungsten oxide electrode); 2 reference electrode (silver.silver chloride electrode); 3 counter electrode (platinum mesh electrode); 4 ion exchange membrane (Nafion); 5 oxidation cell; 6 reduction cell; 7 external circuit

DETAILED DESCRIPTION OF THE INVENTION

BEST MODE FOR CARRYING OUT THE INVENTION

The present invention is explained in detail in the following.

The present invention comprises irradiating light to a photoelectrode comprised of metal oxide while applying a given potential (i.e., photoelectrochemical reaction) in the presence of an aromatic compound to introduce a hydroxyl group into the 1- and 4-positions of a benzene ring, thereby converting the aromatic compound to the corresponding aromatic hydroxide.

In the aromatic compound represented by the formula (1), examples of the "alkyl group having a carbon atom number of 1 to 20" for the substituent $R^1$, $R^2$, $R^3$ or $R^4$ include a methyl group, an ethyl group, an n-propyl group, an isopropyl group, an n-butyl group, a sec-butyl group, a tert-butyl group, an n-pentyl group, an isopentyl group, a neopentyl group, a sec-pentyl group, a tert-pentyl group, an n-hexyl group, an n-octyl group, an n-decyl group, an n-dodecyl group, an n-pentadecyl group, an n-eicosyl group and the like, with preference given to a methyl group, an ethyl group, an isopropyl group, a tert-butyl group and a tert-pentyl group.

$R^1$ and $R^2$ and/or $R^3$ and $R^4$ may be bonded to each other to form a ring. The "ring" is a 4- to 8-membered cycloalkene ring, for example, a cyclobutene ring, a cyclopentene ring, a cyclohexene ring, a cycloheptene ring, a cyclooctene ring and the like.

Examples of the aromatic compound represented by the formula (1) include benzene, toluene, ethylbenzene, n-propylbenzene, cumene, tert-butylbenzene, o-xylene, m-xylene, p-xylene, o-diethylbenzene, m-diethylbenzene, p-diethylbenzene, o-cymene, m-cymene, p-cymene, tetralin, 1,2,3,4,5,6,7,8-octahydroanthracene and the like. Preferred are benzene and toluene, and more preferred is benzene.

Examples of the aromatic hydroxide represented by the formula (2) include hydroquinone, methylhydroquinone, ethylhydroquinone, n-propylhydroquinone, isopropylhydroquinone, tert-butylhydroquinone, 2,3-dimethylhydroquinone, 2,5-dimethylhydroquinone, 2,6-dimethylhydroquinone, 2,3-diethylhydroquinone, 2,5-diethylhydroquinone, 2,6-diethylhydroquinone, 2,5-dihydroxy-o-cymene, 2,5-dihydroxy-m-cymene, 2,5-dihydroxy-p-cymene, 5,6,7,8-tetrahydro-1,4-naphthalenediol, 1,2,3,4,5,6,7,8-octahydro-9,10-anthracenediol and the like. Preferred are hydroquinone and methylhydroquinone, and more preferred is hydroquinone.

In the present production method, a monohydroxy compound, a trihydroxy compound or quinones may be produced. Under preferable conditions, however, a dihydroxy compound (i.e., aromatic hydroxide represented by the formula (2)) is preferentially produced.

Examples of the metal of the "metal oxide" in the present invention include titanium, zirconium, hafnium, vanadium, niobium, tantalum, chrome, molybdenum, tungsten and the like. Preferred are titanium and tungsten, and more preferred is tungsten. Examples of the "metal oxide" include oxide containing at least one kind of the aforementioned metals. Preferred are titanium oxide, zirconium oxide, vanadium oxide, niobium oxide, molybdenum oxide and tungsten oxide, and more preferred is tungsten oxide.

The "metal oxide" may contain a metal acid salt. Examples of the "metal acid salt" include barium titanate, strontium titanate, bismuth vanadate, bismuth tungstate, strontium tungstate and the like, with preference given to bismuth tungstate.

The "metal oxide" in the present invention is preferably a colloidal metal oxide prepared by ion exchange of the corresponding metal acid salt. For example, a colloidal tungsten oxide can be produced by ion exchange of tungstate (preferably sodium tungstate) (to be specific, e.g., exchange of sodium ion of sodium tungstate to proton). Using a colloidal metal oxide prepared by ion exchange of the corresponding metal acid salt, a photoelectrode having a large effective specific surface area and good charge mobility, and therefore, a high photocurrent (reaction efficiency) can be produced.

In the present invention, the "photoelectrode comprised of metal oxide" is an electrode coated with a metal oxide. While such electrode is not particularly limited, a transparent electrode is preferably used, since electrons in the metal oxide particles near the electrode, which have been produced by irradiation of light from the back side of the electrode, can efficiently move to the electrode without rebinding to a hole and, as a result, the irradiated light can be effective utilized. Examples of the transparent electrode include ITO (tin-doped indium oxide) electrode, FTO (fluorine-doped tin oxide) electrode and the like, with preference given to FTO electrode. The "photoelectrode comprised of metal oxide" can be produced, for example, by a method including coating an electrode with a metal oxide solution, and calcinating the electrode, a method including calcinating the corresponding metal plate to oxidize the surface, a method including forming a film by sputtering the corresponding metal species on an electrode and oxidizing the electrode by calcination and the like.

In the production method of the present invention, the above-mentioned "photoelectrode comprised of metal oxide" is used as a working electrode and a given potential is applied thereon. A potential can be generally applied by what is called a "three-electrode mode" wherein a working electrode, a counter electrode and a reference electrode are used and a potential is applied to the working electrode. Alternatively, what is called a "two-electrode mode" wherein a reference electrode is not used, a working electrode and a counter electrode are used, and a potential is applied between them.

As the above-mentioned "counter electrode", an electrode used for general electrolytic reaction can be used. Since electrons supplied from a working electrode via a counter electrode can be efficiently reacted (e.g., production of hydrogen by reduction of water), a platinum mesh electrode having high catalyst activity and a large effective surface area is preferable. As the above-mentioned "reference electrode", an electrode used for general electrolytic reaction can be mentioned. Since the components contained in a reference electrode do not inhibit the object reaction (hydroxylation of aromatic compound), a silver-silver chloride electrode is preferable. Examples of the supporting electrolyte to be used for application of a potential include sodium sulfate, sodium hydroxide, sulfuric acid, potassium sulfate, potassium hydroxide, sodium chloride, potassium chloride, hydrochloric acid, sodium nitrate, potassium nitrate, nitric acid, sodium perchlorate, potassium perchlorate, perchloric acid, tetrabutylammonium perchlorate and the like. Among these, sodium sulfate, sodium hydroxide and sulfuric acid are preferable, since they do not contribute to the reaction at the above-mentioned given potential. It is more preferable to appropriately mix them and adjust to pH 2-pH 10 and then used, and it is still more preferable to use a solution adjusted to the neutral pH 6-pH 8 to prevent corrosion of metal oxide.

The above-mentioned given potential varies depending on the kind of the metal oxide of the "photoelectrode comprised of metal oxide", selection of "two-electrode mode" or "three-electrode mode" to be employed and the like, it is, for example, −0.5 V-2.0 V, preferably 0.4 V-1.5 V. For example, when a photoelectrode comprised of tungsten oxide is used as a working electrode, a silver-silver chloride electrode is used as a reference electrode, and a platinum mesh electrode is used as a counter electrode, a potential lower than 0.4 V decreases the obtained photocurrent to lower the reaction rate, and a potential higher than 1.5 V causes a concurrent electrochemical oxidation reaction (e.g., oxidation of water) on the electrode surface to lower the reaction rate. When, for example, a reference electrode is not used, and a potential is applied between a photoelectrode comprised of tungsten oxide (working electrode) and a platinum mesh electrode (counter electrode), moreover, a potential of 0.4 V-1.5 V is preferable for the same reason as mentioned above.

Figure 2:
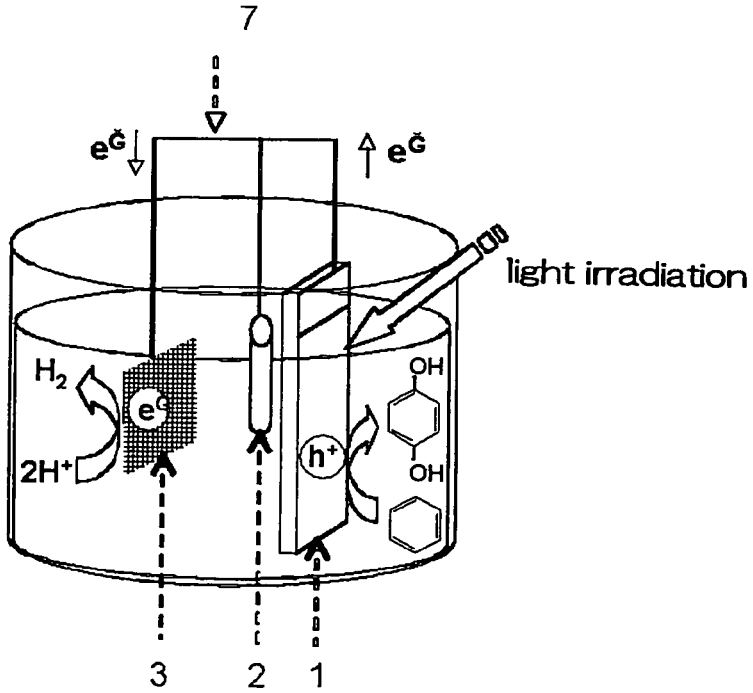
FIG. 2 shows the constitution of a one-compartment cell type apparatus used to perform the production method of the present invention.

The apparatus to be used for performing the production method of the present invention is not particularly limited as long as the photoelectrochemical reaction can be carried out and, for example, an electrolysis cell and the like can be mentioned. Specifically, a one-compartment cell type apparatus wherein a photoelectrode comprised of metal oxide (working electrode) and a counter electrode are set in one cell (e.g., FIG. 2), a two-compartment cell type apparatus wherein a photoelectrode comprised of metal oxide (working electrode) and a counter electrode are separated by an ion exchange membrane (i.e., working electrode and counter electrode are set in different cells) (e.g., FIG. 1) and the like can be mentioned. In view of the yield and selectivity of the object product, a two-compartment cell type apparatus is preferably used.

While the light to be irradiated in the production method of the present invention is not particularly limited, irradiation of light including the visible light region is preferable, irradiation of light having a wavelength of not less than 300 nm is more preferable, and particularly, irradiation of visible light (particularly, visible light having a wavelength of not less than 400 nm alone) is more preferable to suppress direct photoreaction of an aromatic compound represented by the formula (1). While the irradiation time varies depending on time course changes of the production rate of the object product and the electric current efficiency, it is generally, 1-12 hr. The light source is not particularly limited and, for example, xenon lamp, tungsten lamp, high-pressure mercury lamp, light-emitting diode, fluorescent lamp, black light, sunlight and the like can be mentioned.

The reaction (application of potential and irradiation of light) is preferably performed in the presence of a solvent. While the solvent is not particularly limited, a nitrile compound such as acetonitrile, propionitrile and the like, an alcohol compound such as methanol, ethanol, n-propanol, isopropanol and the like, a ketone compound such as acetone, methylethyl ketone, diethylketone and the like, an ester compound such as ethyl acetate, methyl acetate and the like, an amide compound such as N,N-dimethylformamide, N,N-dimethylacetamide, N-methylpyrrolidone and the like, water, and a mixture thereof can be mentioned. Preferred is a solvent containing water, and more preferred is a mixed solvent of water and acetonitrile where the mixing ratio is any. A preferable mixing ratio (volume ratio) is water:acetonitrile=5:95–95:5, more preferably 50:50.

While the temperature of the reaction (addition of potential and irradiation of light) is not particularly limited, it is generally within the range of 20-30° C.

While the gas atmosphere for the reaction (addition of potential and irradiation of light) is not particularly limited, an inert gas atmosphere of nitrogen, argon and the like is preferable. In addition, to suppress a peroxidation reaction due to radical chain reaction, oxygen in the solvent is preferably removed by an operation such as bubbling of inert gas and the like before irradiation of light.

EXAMPLES

The present invention is explained in more detail in the following by referring to Examples, which are not to be construed as limitative.

The resultant product was analyzed by high performance liquid chromatography. The detailed conditions are as follows.

UV detector: SHIMADZU SPD-10A vp (detection wavelength 210 or 245 nm)

solvent delivery pump: SHIMADZU LC-10AT thermostatic tank: SHIMADZU CTO-10As vp mobile phase: acetonitrile: 10 $mmolL^{-1}$ aqueous phosphoric acid solution mixed at volume ratio of 4:6 flow rate: 0.5 mL $min^{-1}$ column: shodex ODP2 HP-4E thermostatic tank temperature: 40° C.

In addition, each resultant product was fractionated by high performance liquid chromatography and fraction collector (SHIMADZU FRC-10A), and the molecular structure was identified by gas chromatography equipped with a mass spectrometer. The detailed conditions are shown below.

gas chromatography: SHIMADZU GC-17A
mass spectrometer: SHIMADZU GC-MS-QP5050
capillary column: J&W SCIENTIFIC INC (length: 30 m, inner diameter: 0.250 mm)
carrier gas: helium
ion source: chemical ionization method (CI method)
reaction gas: isobutane
oven temperature setting: after injection of sample, temperature is maintained at 80° C. for 3 min and raised to 250° C. at a rate of 25° C. $min^{-1}$ The electric current efficiency in this reaction was calculated as follows.

Electric current efficiency relative to resultant product (%)=amount of hydroxide compound/number of electrons that passed external circuit Example 1

[Preparation of Tungsten Oxide Electrode]

Sodium tungstate dihydrate (Wako Pure Chemical Industries, Ltd., 8.3 g) was dissolved in ion exchange water (30 mL), and the solution was passed through an ion exchange resin (Dow Chemical Company, DOWEX 500W-X2, volume 80 mL) to exchange sodium ion with hydrogen ion and added dropwise to ethanol (Wako Pure Chemical Industries, Ltd., 100 mL). Polyethylene glycol (Wako Pure Chemical Industries, Ltd., PEG300, 30 g) was added to the solution. The obtained solution was distilled off under reduced pressure in a rotary evaporator and concentrated to half volume. Both ends of transparent fluorine-doped tin oxide (FTO) conductive glass (Asahi Glass Co., Ltd., length 50 mm, width 10 mm) were masked with a mending tape, and the tungsten acid solution obtained above was applied to the exposed part (length 40 mm, width 10 mm) of the transparent conductive glass. After removing the mending tape, the glass was precalcined at 100° C. (rise time: 10 min, retention time: 60 min), and further calcined at 500° C. (rise time: 40 min, retention time: 30 min). The above-mentioned coating and calcination were repeated 5 times total to give a tungsten oxide electrode.

[Oxidation Reaction of Benzene]

The oxidation reaction of benzene was performed using a two-compartment cell type apparatus (made of Pyrex glass, each cell inner volume: 15 mL) divided by an ion exchange membrane (Ardrich, Nafion 115). A tungsten oxide electrode produced by the aforementioned method was used as a working electrode, and a platinum mesh electrode was used as a counter electrode and a silver-silver chloride (Ag/AgCl) electrode was used as a reference electrode. The working electrode and reference electrode were set in the same cell, and the platinum counter electrode was set in the other cell. In a mixed solvent of acetonitrile and water (volume ratio 1:1) was dissolved sodium sulfate corresponding to 0.1 mol/L to give a reaction solution (pH=5.9). The solution was placed in each cell by 7.5 mL, and bubbled with an argon gas for 30 min to substitute the air dissolved in the solution in the cell with an argon gas. Thereafter, 332 μL of benzene was added to the cell on the working electrode side to 0.5 mol/L, the cell was tightly sealed, and the solution was stirred with a magnetic stirrer. Visible light was irradiated to the working electrode while applying a given potential (0.6 V vs. Ag/AgCl) using a potentiostat (Hokuto Denko Corporation, HA-151A). Using a xenon lamp (300 W, manufactured by Cermax) equipped with an ultraviolet cut filter (L-42, manufactured by AGC Techno Glass Co., Ltd.) as a light source, visible light having a wavelength of not less than 400 nm alone was irradiated. The solution (25 μL) was taken every 15 min of light irradiation, and analyzed by high performance liquid chromatography. In addition, the electric current flown to an external circuit was measured with a digital multimeter (ADVANTEST ADCE 7351E). Hydroquinone and phenol increased with the passage of light irradiation time, and the amount produced in one hour was 57.8 μmol and 2.6 μmol, respectively, and the electric current efficiency relative to the amount produced was 95.3% and 4.3%, respectively. Substances other than the hydroxide compound of benzene were quantified. As a result, 1.9 μmol of adipic acid was confirmed to be present as a cleavage compound of benzene ring.

Example 2

In the same manner as in Example 1 except that bubbling with an argon gas before addition of benzene was not performed, an oxidation reaction of benzene was performed. As a result of the analysis by high performance liquid chromatography, the amount of hydroquinone and phenol produced in one hour was 84.4 μmol and 3.2 μmol, respectively, and the electric current efficiency relative to the amount produced was 65.1% and 2.5%, respectively. As a result of quantification of substances other than hydroxide compound of benzene, 95.3 μmol of maleic acid and 40.5 μmol of adipic acid were confirmed to be present as cleavage compounds of benzene ring.

Example 3

In the same manner as in Example 1 except that a one-compartment cell type apparatus was used instead of the two-compartment cell type apparatus, an oxidation reaction of benzene was performed. As a result of the analysis by high performance liquid chromatography, the amount of hydroquinone and phenol produced in one hour was 98.3 μmol and 2.7 μmol, respectively, and the electric current efficiency relative to the amount produced was 65.1% and 1.8%, respectively.

Example 4

In the same manner as in Example 1 except that a one-compartment cell type apparatus was used instead of the two-compartment cell type apparatus and bubbling with an argon gas before addition of benzene was not performed, an oxidation reaction of benzene was performed. As a result of the analysis by high performance liquid chromatography, the amount of hydroquinone and phenol produced in one hour was 56.7 μmol and 2.6 μmol, respectively, and the electric current efficiency relative to the amount produced was 47.6% and 2.1%, respectively.

Example 5

In the same manner as in Example 1 except that the potential applied to the working electrode was set to 0.4 V (vs. Ag/AgCl), an oxidation reaction of benzene was performed. As a result of the analysis by high performance liquid chromatography, the amount of hydroquinone and phenol produced in one hour was 46.0 μmol and 0.9 μmol, respectively, and the electric current efficiency relative to the amount produced was 62.2% and 1.3%, respectively.

Example 6

In the same manner as in Example 1 except that the potential applied to the working electrode was set to 0.8 V (vs.

Ag/AgCl), an oxidation reaction of benzene was performed. As a result of the analysis by high performance liquid chromatography, the amount of hydroquinone and phenol produced in one hour was 93.1 μmol and 2.5 μmol, respectively, and the electric current efficiency relative to the amount produced was 78.0% and 2.1%, respectively.

Example 7

In the same manner as in Example 1 except that the potential applied to the working electrode was set to 1.0 V (vs. Ag/AgCl), an oxidation reaction of benzene was performed. As a result of the analysis by high performance liquid chromatography, the amount of hydroquinone and phenol produced in one hour was 37.0 μmol and 5.8 μmol, respectively, and the electric current efficiency relative to the amount produced was 14.6% and 2.3%, respectively.

Example 8

In the same manner as in Example 1 except that the reaction solution was adjusted to pH 2.1 with sulfuric acid, an oxidation reaction of benzene was performed. As a result of the analysis by high performance liquid chromatography, the amount of hydroquinone and phenol produced in one hour was 53.6 μmol and 3.7 μmol, respectively, and the electric current efficiency relative to the amount produced was 39.3% and 2.7%, respectively.

Example 9

In the same manner as in Example 1 except that the reaction solution was adjusted to pH 8.3 with sodium hydroxide, an oxidation reaction of benzene was performed. As a result of the analysis by high performance liquid chromatography, the amount of hydroquinone and phenol produced in one hour was 109.0 μmol and 6.8 μmol, respectively, and the electric current efficiency relative to the amount produced was 74.6% and 2.8%, respectively.

Example 10

In the same manner as in Example 1 except that 100% of water was used as the reaction solvent, an oxidation reaction of benzene was performed. As a result of the analysis by high performance liquid chromatography, the amount of hydroquinone and phenol produced in half hour was 4.9 μmol and 2.2 μmol, respectively, and the electric current efficiency relative to the amount produced was 34.2% and 15.4%, respectively.

Example 11

In the same manner as in Example 1 except that a mixed solvent of acetonitrile and water at a volume ratio 3:7 was used as the reaction solvent, an oxidation reaction of benzene was performed. As a result of the analysis by high performance liquid chromatography, the amount of hydroquinone and phenol produced in half hour was 31.4 μmol and 1.9 μmol, respectively, and the electric current efficiency relative to the amount produced was 59.3% and 3.5%, respectively.

Example 12

In the same manner as in Example 1 except that a mixed solvent of acetonitrile and water at a volume ratio 8:2 was used as the reaction solvent, an oxidation reaction of benzene was performed. As a result of the analysis by high performance liquid chromatography, the amount of hydroquinone and phenol produced in half hour was 43.3 μmol and 3.4 μmol, respectively, and the electric current efficiency relative to the amount produced was 53.1% and 4.1%, respectively.

Example 13

In the same manner as in Example 1 except that a mixed solvent of acetonitrile and water at a volume ratio 95:5 was used as the reaction solvent, an oxidation reaction of benzene was performed. As a result of the analysis by high performance liquid chromatography, the amount of hydroquinone and phenol produced in half hour was 20.4 μmol and 3.4 μmol, respectively, and the electric current efficiency relative to the amount produced was 30.0% and 4.9%, respectively.

Example 14

In the same manner as in Example 1 except that light having a wavelength of not less than 300 nm was irradiated to the working electrode without using an ultraviolet cut filter, an oxidation reaction of benzene was performed. As a result of the analysis by high performance liquid chromatography, the amount of hydroquinone and phenol produced in one hour was 281 μmol and 7.8 μmol, respectively, and the electric current efficiency relative to the amount produced was 81.9% and 2.3%, respectively. In addition, 1.2 μmol of biphenyl was produced as a coupling compound of benzene.

Comparative Example 1

In the same manner as in Example 1 except that the light was not irradiated to the working electrode, an oxidation reaction of benzene was performed. As a result of the analysis by high performance liquid chromatography, hydroquinone and phenol were not detected in one hour.

Comparative Example 2

In the same manner as in Example 1 except that a potential was not applied to the working electrode, an oxidation reaction of benzene was performed. As a result of the analysis by high performance liquid chromatography, hydroquinone and phenol produced were not detected in one hour.

Comparative Example 3

A mixed solvent (7.5 mL) of acetonitrile and water (volume ratio 1:1) was placed in a Pyrex glass test tube (inner volume 15 mL), tungsten oxide powder (manufactured by Kojundo Chemical Laboratory Co., Ltd., 10 mg) was added thereto, and the mixture was uniformly stirred with a magnetic stirrer. By bubbling with an argon gas for 30 min, the air dissolved in the solution in the test tube was substituted with an argon gas. Thereafter, 332 μL of benzene was added to 0.5 mol/L, the test tube was tightly sealed, and visible light having a wavelength of not less than 400 nm alone was irradiated for one hour using a xenon lamp equipped with an ultraviolet cut filter. The solution was centrifuged (3000 rpm, 30 min) to precipitate tungsten oxide powder, and the supernatant was analyzed by high performance liquid chromatography. As a result, the amount of hydroquinone and phenol produced in one hour was 0 μmol and 0.1 μmol, respectively.

Comparative Example 4

In the same manner as in Comparative Example 3 except that bubbling with an argon gas was not performed, an oxidation reaction of benzene was performed. As a result of the analysis by high performance liquid chromatography, the amount of hydroquinone and phenol produced in one hour was 6.3 μmol and 11.7 μmol, respectively.

INDUSTRIAL APPLICABILITY

According to the production method of the present invention, two hydroxyl groups can be introduced into the 1-position and the 4-position of the benzene ring of an aromatic compound highly efficiently and highly selectively by a one step process to give the corresponding aromatic hydroxide.

This application is based on a patent application No. 2008-162152 filed in Japan, the contents of which are incorporated in full herein by this reference.

The invention claimed is:

1. A production method of an aromatic hydroxide represented by the formula (2)

(2)

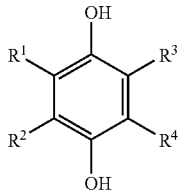

wherein $R^1$, $R^2$, $R^3$, and, $R^4$ are each independently a hydrogen atom or an alkyl group having a carbon atom number of 1-20, and $R^1$, $R^2$ and/or $R^3$ and $R^4$ are optionally bonded to each other to form a ring, which comprises irradiating light to a photoelectrode comprised of metal oxide while applying a given potential in the presence of an aromatic compound represented by the formula (1)

(1)

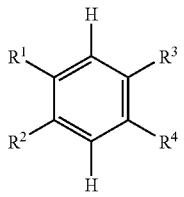

wherein $R^1$, $R^2$, $R^3$, and $R^4$ are as defined above.

2. The production method of claim 1, wherein $R^1$, $R^2$, $R^3$, and $R^4$ are each a hydrogen atom.

3. The production method of claim 1, wherein the metal oxide comprises tungsten oxide.

4. The production method of claim 1, wherein the metal oxide is tungsten oxide.

5. The production method of claim 4, wherein the tungsten oxide is prepared by ion exchange of tungstate.

6. The production method of claim 5, wherein the tungstate is sodium tungstate.

7. The production method of claim 1, wherein the photoelectrode comprised of metal oxide is obtained by coating a transparent electrode with metal oxide.

8. The production method of claim 7, wherein the transparent electrode is a fluorine-doped tin oxide (FTO) electrode.

9. The production method of claim 1, wherein the light comprises a visible light region.

10. The production method of claim 1 wherein the light is a visible light.

11. The production method of claim 1 which is performed using a two-compartment cell type apparatus wherein the photoelectrode comprised of metal oxide and the counter electrode are separated by an ion exchange membrane.

12. The production method of claim 1, which is performed in the presence of a solvent.

13. The production method of claim 12, wherein the solvent comprises water.

14. The production method of claim 12, wherein the solvent is a mixed solvent of acetonitrile and water.

15. The production method of claim 12, wherein oxygen is removed from the solvent before irradiation of light.

16. The production method of claim 1, wherein the given potential is −0.5 V-2.0 V.

* * * * *

UNITED STATES PATENT AND TRADEMARK OFFICE

CERTIFICATE OF CORRECTION

PATENT NO. : 7,714,175 B2
APPLICATION NO. : 12/385013
DATED : May 11, 2010
INVENTOR(S) : Ryu Abe, Bunsho Ohtani and Osamu Tomita It is certified that error appears in the above-identified patent and that said Letters Patent is hereby corrected as shown below:

On the Title page, item (73), correct the country of the first Assignee as follows (information provided correctly on Issue Fee Transmittal):

"Sumitomo Chemical Company, Limited, Tokyo (JO)" should be:
--Sumitomo Chemical Company, Limited, Tokyo (JP)--.

Signed and Sealed this

Fourteenth Day of December, 2010

David J. Kappos

David J. Kappos
*Director of the United States Patent and Trademark Office*